US006588743B2

(12) United States Patent
Yap

(10) Patent No.: US 6,588,743 B2
(45) Date of Patent: Jul. 8, 2003

(54) ADJUSTABLE URGING FORCE SYSTEM FOR STACKER PADDLE

(75) Inventor: Anthony E. Yap, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/003,452

(22) Filed: Oct. 25, 2001

(65) Prior Publication Data

US 2003/0080499 A1 May 1, 2003

(51) Int. Cl.[7] ..... B65H 31/06

(52) U.S. Cl. ..... 271/215; 271/207; 271/213; 271/214

(58) Field of Search ..... 271/207, 214, 271/215, 213, 152, 176, 199

(56) References Cited

U.S. PATENT DOCUMENTS 4,065,123 A * 12/1977 Arrasmith et al. ..... 271/178
4,524,965 A * 6/1985 Kulpa ..... 267/74
4,951,934 A * 8/1990 Prins ..... 271/181
4,953,748 A * 9/1990 Wheelock ..... 221/198
5,221,080 A * 6/1993 Ricciardi ..... 271/2
5,305,996 A * 4/1994 Taniwa et al. ..... 271/126
5,524,876 A * 6/1996 Porter ..... 271/178
6,419,221 B1 * 7/2002 Spall ..... 271/129

FOREIGN PATENT DOCUMENTS

JP 62-105859 * 5/1987

* cited by examiner

*Primary Examiner*—Patrick H. Mackey
(74) *Attorney, Agent, or Firm*—Michael J. Cummings; Charles R. Malandra, Jr.; Angelo N. Chaclas

(57) ABSTRACT

A paddle urging system for use in a stacking bin having a constant force spring to provide an urging force to a paddle for supporting a stack of mailpieces. As mailpieces are accumulated into the stack, they push the stack against the paddle. A brake/clutch system is used to provide an additional drag to the paddle to resist against this movement of the paddle. The brake/clutch system is adjustable so that heavy mailpieces are supported more effectively, whereas lightweight mailpieces encounter less resistant force when they are accumulated into the stack.

11 Claims, 4 Drawing Sheets

ADJUSTABLE URGING FORCE SYSTEM FOR STACKER PADDLE

FIELD OF THE INVENTION

The present invention relates generally to a mail or document stacking machine and, more particularly, to a stack support for providing a resisting force to the stack as the mailpiece or document is accumulated into the stack.

BACKGROUND OF THE INVENTION

In a typical mail-handling machine, mailpieces are sorted and pushed into a plurality of stacking bins where the mailpieces are accumulated in substantially vertical stacks. In each stacking bin, a paddle, or an abutment member, is used to support the stack while allowing the stack thickness to increase. In order to providing sufficient support to the growing stack, a resisting force is usually provided to the paddle against the stack. As disclosed in U.S. Pat. No. 5,429,249 (Belec et al.), the paddle 40 is slidably mounted on a shaft or bar 32 by means of a cylindrical shaped member 34. The cylindrical shaped member 34 is spring-loaded to provide a resisting force 150 to the paddle 40 as the stack 100 is pushed in a direction 102 when the mailpiece 110 is accumulated into the stack 100 by an input mechanism 90, as shown in FIG. 1. As disclosed in U.S. Pat. No. 4,524,965 (Kulpa), one end of a cord 54 is tied to the cylindrical shaped member 34 and the other end of the cord 54 is wrapped around a rotary displacement device 60. As the cylindrical member 34, along with the paddle 40 and the stack 100, is pushed along the direction 102, it causes the rotary displacement device 60 to rotate along a rotation direction 106, as shown in FIG. 2. A pulley 70 is fixedly mounted on the rotary displacement device 60 for motion. One end of another cord 52 is wrapped around the pulley 70 and the other end of the cord 52 is tied to a spring 50. When the rotary displacement device 60 is rotated along the rotation direction 106, it causes the spring 50 is stretched along the direction 104. As the spring 50 is stretched, it increases the tension 202 in the cord 52, thereby increasing the resistance force 150 provided to the paddle 40.

While the resisting force providing systems, as disclosed in Belec et al. and in Kulpa, are useful in supporting a stack of mailpieces as the thickness of the stack increases, the resisting force cannot be adjusted according to the load of the mailpieces. On the one hand, if the resistance force is too high, then lightweight mailpieces may be damaged when they are accumulated into the stack. On the other hand, if the resistance force is too low, the stack may overpower the paddle and cause the entire stack to topple over.

It is advantageous and desirable to provide a stack urging force system wherein the resistance force provided to the paddle is adjustable according to the load of the mailpieces.

SUMMARY OF THE INVENTION

According to first aspect of the present invention, a paddle urging system for use in a stacking bin having a first end and an opposing second end, wherein a paddle is provided in the stacking bin to support a stack of mailpieces in the stacking bin and wherein the mailpieces are accumulated into the stack at the first end of the stacking bin, thereby increasing the thickness of the stack and pushing the stack against the paddle in a first direction toward the second end of the stacking bin, said paddle system comprising:

an urging mechanism, operatively connected to the paddle, for providing an urging force to urge the paddle to move in a second direction opposite from the first direction while supporting the stack; and an adjustable resisting force mechanism, operatively connected to the urging mechanism, for providing a resisting force to the paddle against the pushing of the stack toward the second end when the mailpieces are accumulated into the stack, in addition to the urging force provided by the urging mechanism.

According to the present invention, wherein the urging mechanism comprises a spring, connected to the paddle by a flexible member, for providing the urging force to the paddle.

According to the present invention, the adjustable resisting force mechanism comprises a clutch system for providing the resisting force, and the flexible member is mechanically engaged with the clutch system for conveying the resisting force provided by the clutch to the paddle.

According to the present invention, the clutch system comprises a pulley engaged with a one-way clutch such that the pulley is allowed to turn in a first rotation direction with respect to a rotation axis and the pulley is prevented from turning in a second rotation direction opposite from the first rotation direction, and wherein the one-way clutch is further engaged with a rotating member with an adjustable friction force and the rotating member is disposed axially with the rotation axis, such that when the pulley is caused to turn in the second rotation direction by the pushing of the stack toward the second end of the stacking bin, the one-way clutch causes the rotating member to rotate against the friction force for providing the resisting force to the flexible member, and when the pulley is caused to turn in the first rotation direction, the one-way clutch and the rotating member are effectively disengaged from the pulley.

According to the second aspect of the present invention, a stacking bin for use in a mail processing machine for accumulating mailpieces into a stack from a first end of the stack, wherein the stack is pushed toward a first direction when the mailpieces are accumulated into the stack, thereby increase the thickness of the stack and pushing the stack along a first direction, said stacking bin comprising:

a paddle, provided at the second end of the stack opposite from the first end, for supporting the stack, an urging mechanism, operatively connected to the paddle, for providing an urging force to urge the paddle to move against the stack toward a second direction opposite from the first direction; and an adjustable resisting force mechanism, operatively connected to the urging mechanism, for providing a resisting force to the paddle against the pushing of the stack when the mailpieces are accumulated into the stack, in addition to the urging force provided by the urging mechanism.

The present invention will become apparent upon reading the description taken in conjunction with FIGS. 1 to 4.

DETAILED DESCRIPTION OF THE INVENTION

Figure 1:
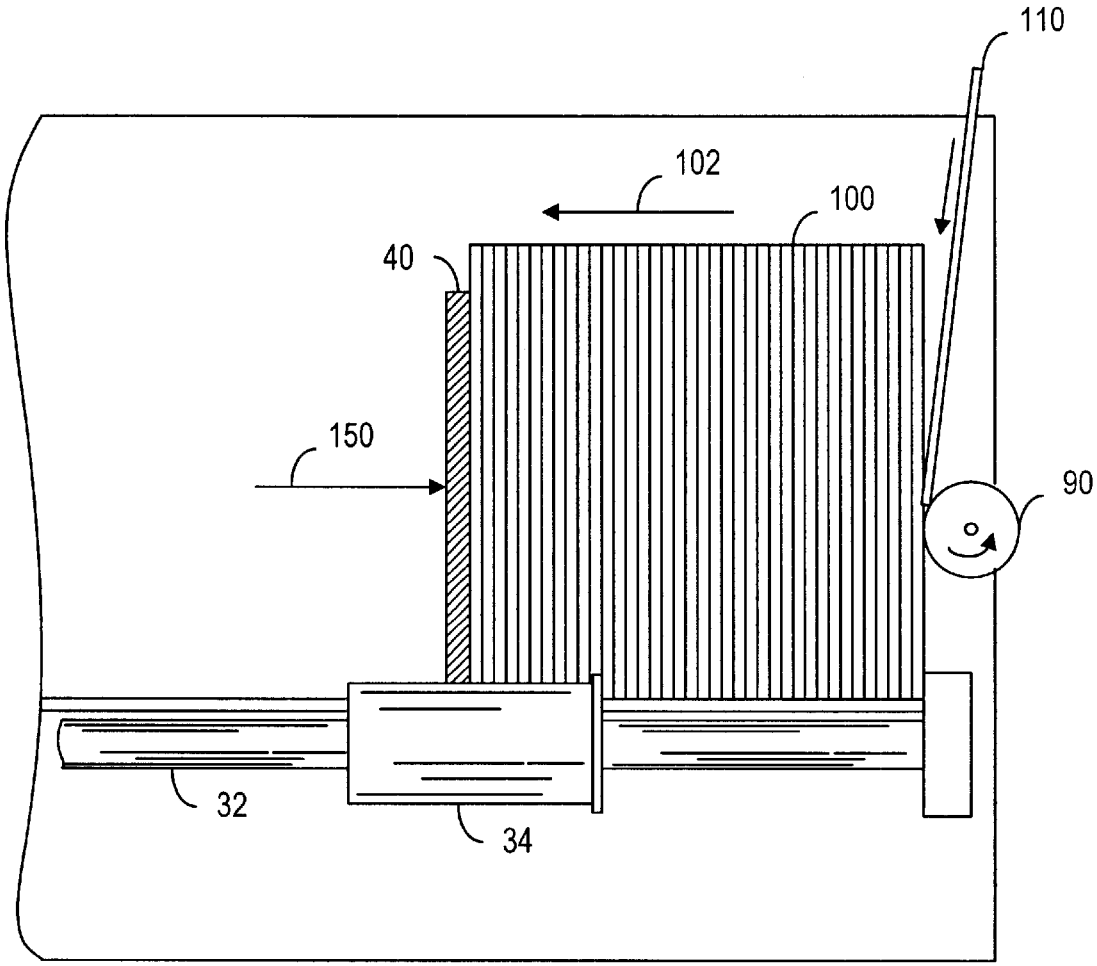
Fig. 1 (Prior Art)
FIG. 1 is a diagrammatic representation showing the top view of a prior art stacking bin.
Figure 2:
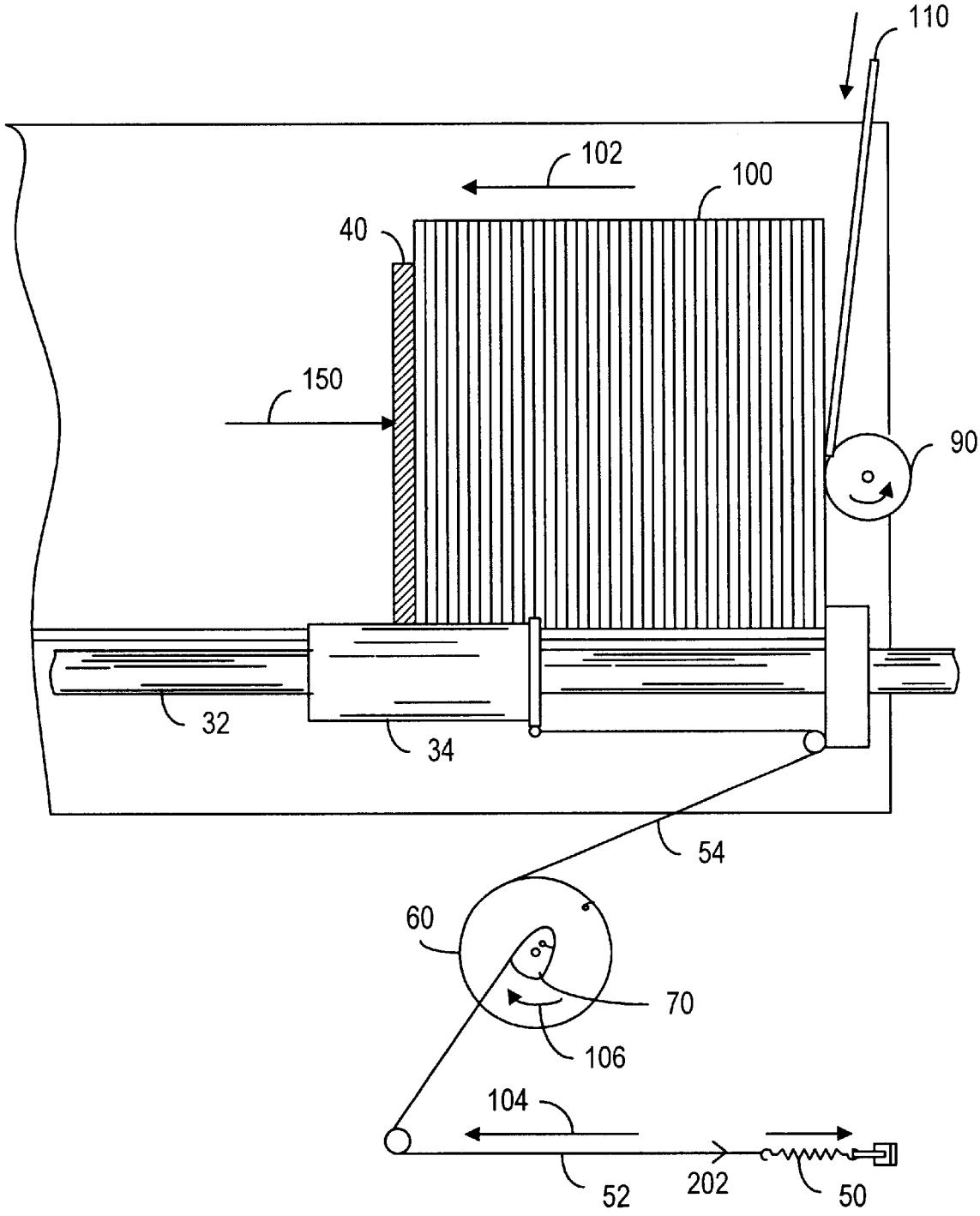
Fig. 2 (Prior Art)
FIG. 2 is a diagrammatic representation showing the top view of another prior art stacking bin.
Figure 3:
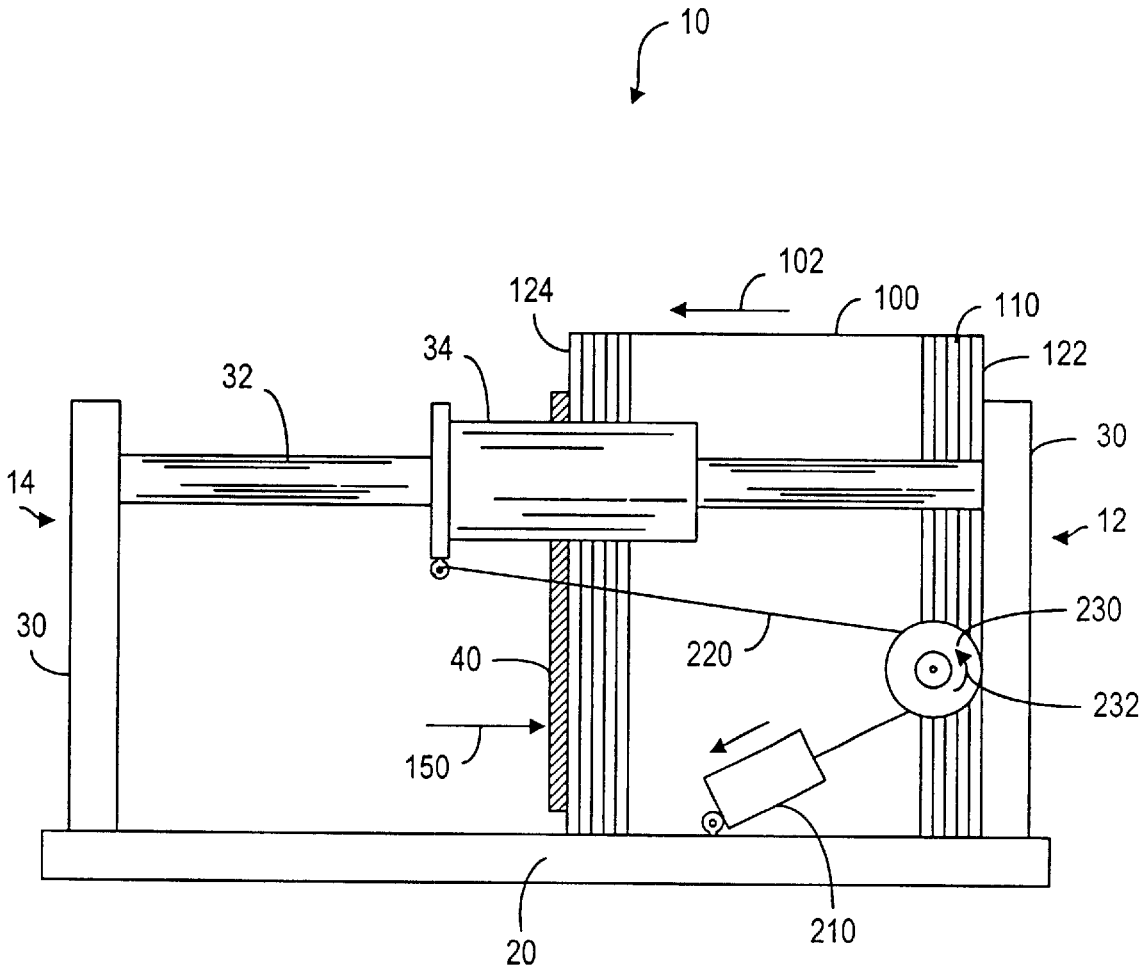
FIG. 3 is a diagrammatic representation showing a side view of the stacking bin, according to the present invention.

As shown in FIG. 3, a stacking bin 10, according to the present invention, has a platform 20 to support a stack 100 of mailpieces 110. The stacking bin 10 has a first end 12 and an opposing second end 14, and the stack 100 has a first end 122 and an opposing second end 124. A paddle 40 is provided at the second end 124 of the stack 10O for supporting the stack 100. As the mailpieces 110 are accumulated into the stack 100 at the first end 12 of the stacking bin, the thickness of the stack 100 increases and the stack 100 is pushed toward the second end 14 along a direction 102. As shown, a shaft 32 is mounted on the platform 20 by means of shaft mounts 30. A sleeve or cylindrical shaped member 34 is slidably mounted on the shaft 32 and a paddle 40 is mechanically connected to the cylindrical shaped member 34 so that the paddle 40 is moved when the cylindrical shaped member 34 is moved along the shaft 32. A spring 210, preferably a constant force spring, mounted on the platform 20, is used to provide an urging force 150 to the paddle 40 via a cord 220 (or a steel cable) and the like. An adjustable resisting force mechanism 230 is operatively connected to the spring 210 to provide an additional force to the paddle when the paddle is pushed toward the second end 14 of the stacking bin 10 as the mailpieces 110 are accumulated into the stack 100. As shown in FIG. 3, the adjustable resisting force mechanism 230 has a one-way clutch, which produces a friction force only when the resisting force mechanism 230 is caused to rotate along a rotation direction 232. There is no significant friction force when the resisting force mechanism 230 is caused to rotate in a direction opposite from the direction 232. Thus, when there is no accumulation, the resistance force 150 provided to the paddle 40 is substantially equal to the tension force of the spring 210, reduced by the friction force between the cylindrical shaped member 34 and the shaft 32, and some small friction force in the resisting force mechanism 230. Moreover, when the stack 100 is taken out to empty the stacking bin 10, the paddle 40 is automatically retracted to the first end 12.

Figure 4:
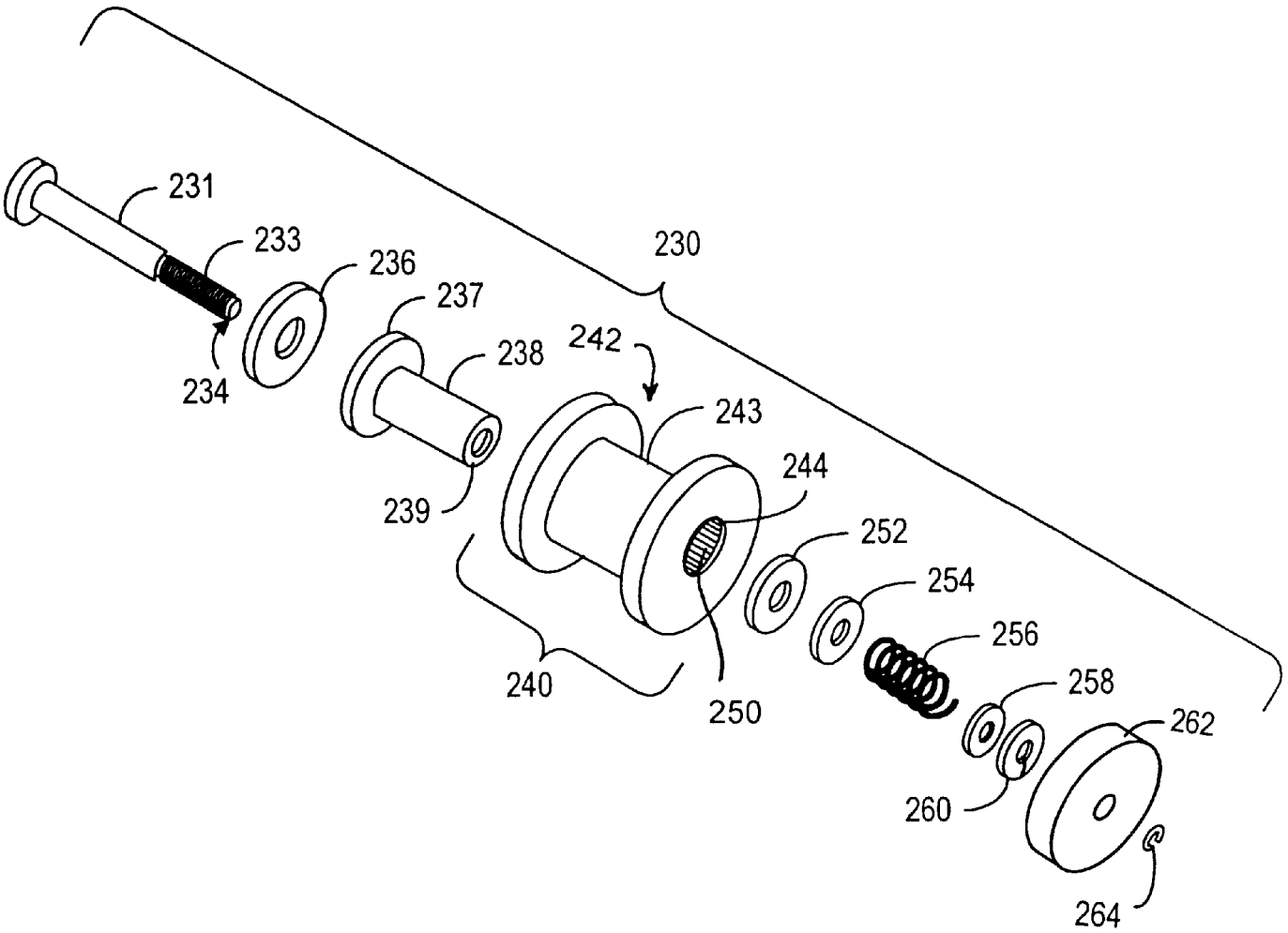
FIG. 4 is an exploded view of the adjustable resisting force mechanism, according to the present invention.

FIG. 4 shows the preferred embodiment of the resisting force mechanism 230. As shown in FIG. 4, the resisting force mechanism 230 comprises a brake shaft 231 for axially mounting a brake disk 236, a brake hub 238, a pulley/clutch assembly 240, a thrust washer 252, a washer 254, a spring 256, washers 258 and 260, an adjustment knob 262 and a retaining ring 264. The pulley/clutch assembly 240 consists of a pulley 242 and a one-way clutch 250. The pulley 242 has an outer periphery 243, around which the cord 220 is wrapped about 1.5 turns for engaging the resisting force mechanism 230 with the paddle 40. This wrap prevents the cord from slipping. The brake shaft 232 has a threaded front section 233 to allow the adjustment knob 262 to screw thereon. The lock washer 264 is pushed onto the tip 234 of the threaded section 233 to prevent the adjustment knob 262 from being mechanically disengaged from the brake shaft 232. A one-way bearing 250 is mounted on the inner periphery 244 of the pulley 242 for engaging with the brake hub 238. The one-way clutch 250 allows the brake hub 238 to rotate against the pulley 240 in a direction, with respect to a rotation axis defined by the longitudinal axis of the brake shaft 232, but prevents the brake hub 238 from doing so in the opposite direction. When these components are assembled, the thrust washer 252 is in direct contact with the front end 239 of the brake hub 238, the brake disk 236 is in direct contact with the rear end 237 of the brake hub 238, and the adjustment knob 262 compresses the spring 256. As such, the spring 256 creates a clamping force between the thrust washer 252, the brake hub 238 and the brake disk 236. The clamping force is adjustable by adjusting the adjustment knob 262 against the spring 256 As mailpieces 110 are accumulated into the stack 100, the movement of the paddle 40 causes the pulley 242 to rotate. The rotation of the pulley 242 causes the one-way clutch 250 to engage the brake hub 238, causing it to turn along with the pulley 242. As the brake hub 238 turns, its motion is resisted by the clamping force, resulting in an addition drag on the entire paddle urging system. The additional drag increases the force required to move the paddle 40 towards the second end 14 The end effect is that heavy mailpieces are supported more effectively. Upon retraction, the one-way clutch 250 overruns, allowing the paddle 40 to return to its home position near the first end 12 without having to overcome the drag provided by the resisting force mechanism 230.

With the adjustment knob 262 turned all the way out, the spring 256 is not compressed and the clamping force between the thrust washer 252, the brake hub 238 and the brake disk 236 does not produce any significant additional drag. At such, the force seen at the paddle 40 is mainly the tension force provided by the constant force spring 210. This setting can be used for mailpieces that are on the lower end of the weight spectrum.

The advantage of the paddle urging system, which comprises the constant force spring 210 and the resisting force mechanism 230, is that it allows the operator to easily adjust the resistance force 150 to an optimal level according to a particular type of mailpiece weight. Once the adjustment knob 262 is turned to a particular setting, the force provided to the paddle 40 remains relatively constant over the full travel of the paddle between the first end 12 and the second end 14 of the stacking bin 10. In contrast, a simple torsion or extension spring normally exhibits a relatively high spring rate, which would cause the paddle force to increase as the stack fills.

The present invention allows a mail sorter operator to adjust the paddle's normal force according to the weight of the mailpieces being handled. The present invention uses a constant force spring 210 as an urging mechanism for providing an initial paddle force and to provide the force required to retract the paddle after the stack has been emptied. In addition, a brake/clutch assembly and a compression spring are used as an adjustable resisting force mechanism for providing a drag when the mailpieces are accumulated into a mail stack. As disclosed, the cord 220 is wrapped around the pulley 242 to engage the adjustable resisting force mechanism 230 with the constant force spring 210. However, it is possible that the adjustable resisting force mechanism 230 is operatively connected to the paddle 40, separately from the constant force spring 210.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A paddle urging system for use in a stacking bin having a first end and an opposing second end, wherein a paddle is provided in the stacking bin to support a stack of mailpieces in the stacking bin and wherein the mailpieces are accumulated into the stack at the first end of the stacking bin, thereby increasing the thickness of the stack and pushing the stack against the paddle in a first direction toward the second end of the stacking bin, said paddle system comprising:

an urging mechanism, operatively connected to the paddle, for providing an urging force to urge the paddle to move in a second direction opposite from the first direction while supporting the stack; and an adjustable resisting force mechanism, operatively connected to the urging mechanism, for providing a resisting force to the paddle against the pushing of the stack toward the second end when the mailpieces are accumulated into the stack, in addition to the urging force provided by the urging mechanism wherein the adjustable resisting force mechanism comprises a clutch system for providing the resisting force, and a flexible member is mechanically engaged with the clutch system for conveying the resisting force provided by the clutch to the paddle; and wherein the clutch system comprises a pulley engaged with a one-way clutch such that the pulley is allowed to turn in a first rotation direction with respect to a rotation axis and the pulley is prevented from turning in a second rotation direction opposite from the first rotation direction, and wherein the one-way clutch is further engaged with a rotating member with adjustable friction force, the rotating member disposed axially with the rotation axis, such that when the pulley is caused to turn in the second rotation direction by the pushing of the stack toward the second end of the stacking bin, the one-way clutch causes the rotating member to rotate against the friction force for providing the resisting force to the flexible member, and when the pulley is caused to turn in the first rotation direction, the one-way clutch and the rotating member are effectively disengaged from the pulley.

2. The paddle urging system of claim 1, wherein the urging mechanism comprises a spring, connected to the paddle by a flexible member, for providing the urging force to the paddle.

3. The paddle urging system of claim 2, wherein the spring is a constant-force spring.

4. The paddle urging system of claim 1, wherein the stacking bin has a shaft running between the first end and the second end of the stacking bin for slidably mounting a cylindrical-shaped member, and the flexible member is attached to the cylindrical-shaped member for providing a mechanical linkage between the urging mechanism and the cylindrical-shaped member, and wherein the paddle is mechanically engaged with the cylindrical-shaped member for moving along therewith.

5. The paddle urging system of claim 1, wherein the clutch system further comprises:

a shaft, the longitudinal axis of which defines the rotation axis, a brake disk axially mounted on the shaft, a thrust washer axially mounted on the shaft, a spring axially mounted on the shaft, at least one further washer axially mounted on the shaft, and an adjustment knob axially mounted on the shaft, and wherein the rotating member comprises a cylindrical-shaped hub axially mounted on the shaft between the brake disk and the thrust washer, and the spring is disposed between the thrust washer and said at least one further washer to allow the adjustment knob to compress the spring via said at least one further washer, thereby creating a clamping force between the thrust washer, the cylindrical-shaped hub and the brake disk for providing the friction force.

6. The paddle urging system of claim 5, wherein the adjustment knob is threadably engaged with the shaft for adjusting the clamping force.

7. The paddle urging system of claim 5, wherein the pulley has an outer periphery and an inner periphery and the cylindrical-shaped hub has a further outer periphery, and wherein the one-way clutch is axially disposed on the inner periphery of the pulley and securely engaged with the further outer periphery of the cylindrical-shaped hub.

8. The paddle urging system of claim 6, wherein the flexible member is a cord for wrapping around the outer periphery of the pulley for mechanically engaging with the pulley.

9. A stacking bin for use in a mail processing machine for accumulating mailpieces into a stack from a first end of the stack, wherein the stack is pushed toward a first direction when the mailpieces are accumulated into the stack, thereby increase the thickness of the stack and pushing the stack along a first direction, said stacking bin comprising:

a paddle, provided at the second end of the stack opposite from the first end, for supporting the stack, an urging mechanism, operatively connected to the paddle, for providing an urging force to urge the paddle to move against the stack toward a second direction opposite from the first direction; and an adjustable resisting force mechanism, operatively connected to the urging mechanism, for providing a resisting force to the paddle against the pushing of the stack when the mailpieces are accumulated into the stack, in addition to the urging force provided by the urging mechanism wherein the adjustable resisting force mechanism comprises a clutch system for providing the resisting force, and a flexible member is mechanically engaged with the clutch system for conveying the resisting force provided by the clutch to the paddle; and wherein the clutch system comprises a pulley engaged with a one-way clutch such that the pulley is allowed to turn in a first rotation direction and the pulley is prevented from turning in a second rotation direction opposite from the first rotation direction, and wherein the one-way clutch is further engaged with a rotating member with an adjustable friction force, the rotating member disposed axially with the rotation axis, such that when the pulley is caused to turn in the second rotation direction by the pushing of the stack along the first direction, the one-way clutch causes the rotating member to rotate against the friction force for providing the resisting force to the flexible member, and when the pulley is caused to turn in the first rotation direction, the one-way clutch and the rotating member are effectively disengaged from the pulley.

10. The stacking bin of claim 9, wherein the urging mechanism comprises a constant force spring, connected to the paddle by a flexible member, for providing the urging force to the paddle.

11. The stacking bin of claim 9, wherein the pulley has an outer periphery and an inner periphery and the rotating member comprises a cylindrical member with an outer periphery, and wherein the one-way clutch is axially disposed on the inner periphery of the pulley and securely engaged with the outer periphery.

* * * * *